United States Patent [19]

Garrard et al.

[11] Patent Number: 4,625,360

[45] Date of Patent: Dec. 2, 1986

[54] SHOE SHINE BOX

[76] Inventors: Burdette Garrard; George Spector, both of 233 Broadway RM 3615, New York, N.Y. 10007

[21] Appl. No.: 636,122

[22] Filed: Jul. 30, 1984

[51] Int. Cl.[4] ..... A47L 23/28

[52] U.S. Cl. ..... 15/265

[58] Field of Search ..... 15/265, 266, 267; D3/305; 217/59; 220/212

[56] References Cited

U.S. PATENT DOCUMENTS

| | | | |
|---|---|---|---|
| 371,036 | 10/1887 | Crandall | 15/265 |
| 1,435,271 | 11/1922 | Aste | 15/265 |
| 1,583,724 | 5/1926 | Lisi | 15/265 |
| 2,627,622 | 2/1953 | Kahl | 15/265 |
| 2,798,245 | 7/1957 | Kesler | 15/265 |

*Primary Examiner*—Edward L. Roberts

[57] ABSTRACT

A shoe shine box is provided and consists of a housing that has a hinged cover that can be flipped over onto a plate member on top of the housing to expose a shoe rest on underside of the cover for a shoe to be shined thereon.

2 Claims, 6 Drawing Figures

SHOE SHINE BOX

BACKGROUND OF THE INVENTION

The instant invention relates generally to shoe polishing devices and more specifically it relates to a shoe shine box.

Numerous shoe polishing devices have been provided in prior art that are adapted to support shoes and store shoe shining paraphernalia within. For example U.S. Pat. Nos. 2,664,585; 2,798,245 and 2,987,750 all are illustrated of such prior art. While these units may be suitable for the particular purpose to which they address, they would not be suitable for the purpose of the present invention as heretofore described.

SUMMARY OF THE INVENTION

A principle object of the present invention is to provide a shoe shine box that has a hinged cover that can be flipped over onto top of the box to expose a shoe rest on underside of the cover for a shoe to be shined thereon.

Another object is to provide a shoe shine box designed at the proper size so that the shoe shine operation may be carried out more efficiently and shoe-shining paraphernalia can be conveniently stored within.

An additional object is to provide a shoe shine box that has an adjustable shoe rest and a sliding leaf spring hinge on the cover.

A further object is to provide a shoe shine box that is simple and easy to use.

A still further object is to provide a shoe shine box that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
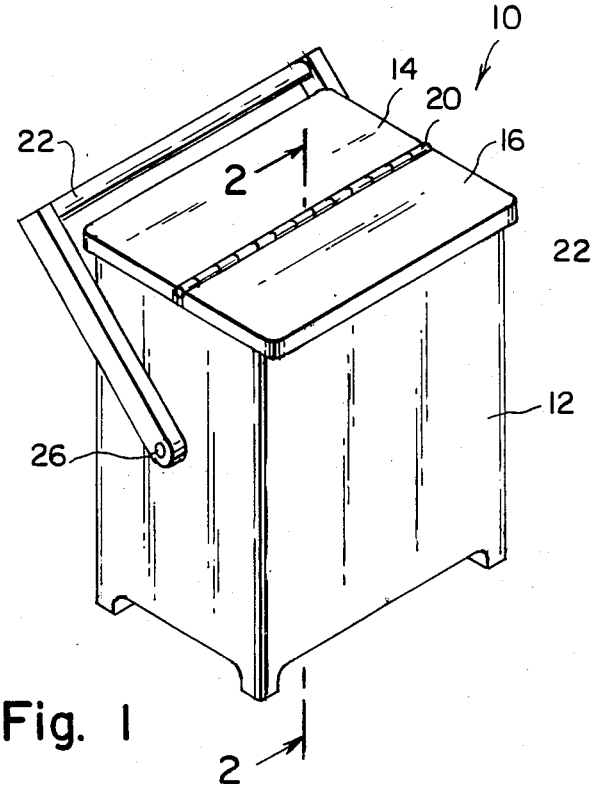
FIG. 1 is a perspective view of the invention with cover closed.
Figure 2:
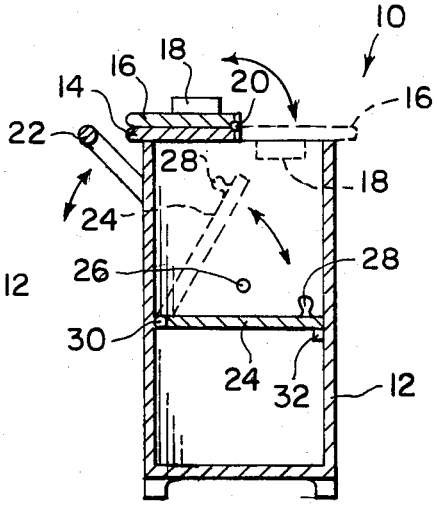
FIG. 2 is a cross sectional view taken along line 2—2 in FIG. 1 with cover open.

Turning now descriptively to the drawings, in which similar reference characters denote similar elements throughout the several vies, FIGS. 1 and 2 illustrates a shoe shine box 10 that consists of a rectangular box-like housing 12, a rectangular plate member 14, a rectangular cover 16 and a shoe rest 18.

The housing 12 has an open top and is adapted to store shoe-shining paraphernalia, such as brushes, polish cloths, polish etc. The plate member 14 is affixed lengthwise to cover one half of the open top of the housing 12 while the cover 16 has a hinge 20 affixed lengthwise at one side to the plate member 14. The shoe rest 18 is mounted to underside of the cover 16 so that when the cover is flipped over onto the plate member 14 the shoe rest will be exposed for a shoe to be shined thereon.

Also provided is a handle 22 and a rectangular shelf member 24. The handle 22 is pivotally mounted at 26 to opposite sides of the housing 12 so that the shoe shine box 10 can be carried easily. The rectangular shelf member 24 has a finger grip knob 28 whereby the shelf member is pivotally engaged within the housing 12 adjacent an end thereof below the plate member 14. The pivotal engagement is a hinge 30 affixed lengthwise to the shelf member 24 opposite the finger grip knob 28. A lug 32 is placed in the housing 12 opposite to and aligned with the hinge 30 to support free end of the shelf member 24 when in a closed position.

Figure 4:
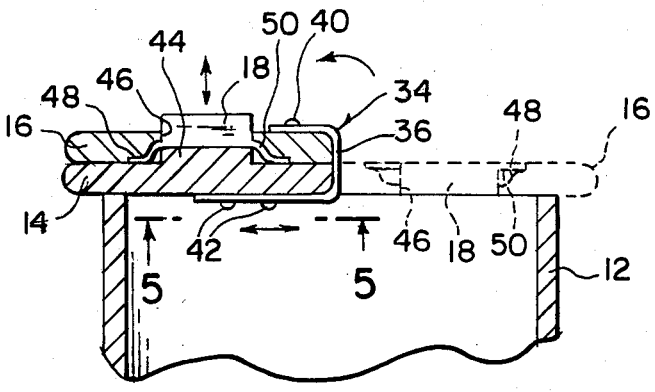
FIG. 4 is an enlarged cross sectional view taken along line 4—4 in FIG. 3 showing the cover open, the adjustable shoe rest in a raised position and a sliding leaf spring hinge.
Figure 5:
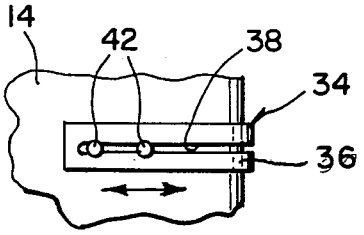
FIG. 5 is a partial bottom view taken along line 5—5 in FIG. 4 showing the slot in the hinge.
Figure 6:
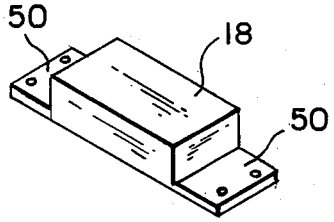
FIG. 6 is a perspective view of the adjustable shoe rest and flexible arms.

FIGS. 4 and 5 show a different type of hinge 34 for the plate member 14 and the cover 16. The hinge 34 consists of a flexible leaf spring 36 that has a longitudinal slot 38 therein. The leaf spring 36 is affixed to underside of the cover 16 by a fastener 40. Other fasteners such as two pins 42 are affixed to underside of the plate member 14 through the slot 38 in the leaf spring 36 so that the leaf spring will slide with respect to the pins 42 when the cover 16 is opened and closed.

Figure 3:
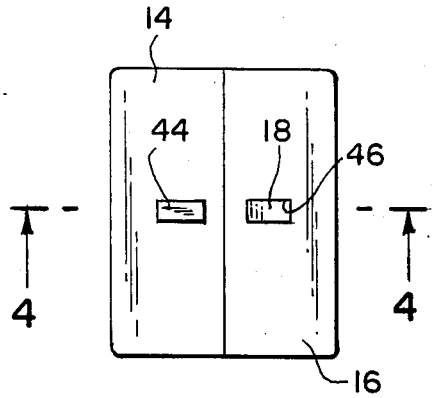
FIG. 3 is a top view of a modification showing the cover closed and an adjustable shoe rest.

FIGS. 3 and 4 show the plate member 14 having a raised portion 44 on top surface thereon. The cover 16 has an aperture 46 therethough with two opposite recesses 48 on top surface of the cover adjacent and curving downwards towards the aperture 46. The raised portion 44 of the plate member 14 is in alignment with the aperture 46 in the cover 16.

The shoe rest 18 has a pair of opposite extending flexible arms 50. The shoe rest 18 is positioned flush within the aperture 46 in the cover 16 with the flexible arms 50 mounted to the recesses 48 near top surface of the cover. When the cover 16 is flipped over onto the plate member 14 the raised portion 44 will engage the shoe rest 18 causing the flexible arms 50 to go into the recesses 48 and forcing the shoe rest to extend outwards from the aperture 46 in the cover 16 for a shoe to be shined thereon.

The shoe shine box 10 should be fabricated from durable materials such as plastic, metal, wood or the like, and come in various solid colors such as red, yellow, blue, white, green, brown, black, etc.

The size of the shoe shine box 10 should be approximately twenty inches high, ten inches wide, fifteen inches long, and the walls one quarter inch thick with all corners rounded. The shoe shine operation may be carried out more efficiently and shoe shining paraphernalia can be conveniently stored within.

While certain novel features of this invention have been shown and described and are positioned out in the annexed claims, it will be understood that various omissions, substitutions and changes in the forms and details of the device illustrated and in its operation can be made by those skilled in the art without departing from the spirit of the invention.

What is claimed is:

1. A shoe shine box which comprises a housing with a top opening having a hinged top for covering said opening to store shoeshining paraphernalia, said top comprising:

(a) a fixed plate affixed lengthwise to cover a portion of said opening;

(b) a pivotable cover for the remainder of said opening having a hinge affixed lengthwise at one side to an adjoining side of said plate moveable to open and closed positions; and (c) a shoe rest provided on said top in both the open and closed positions wherein the cover is pivotal 180° to be superimposed on the plate, further comprising:

(a) said plate having a raised portion on its top surface comprising said shoe rest;

(b) said cover having an aperture therethrough adapted to receive said portion when pivoted 180° to the open position wherein said cover includes a shoe support mounted moveably in said aperture with flexible means whereby said aperture receives said shoe rest to engage said support whereby said shoe support is mounted above said cover when the cover is in said open position.

2. A shoe shine box as recited in claim 1, wherein said flexible means comprises flexible members extending from said support secured to said cover, whereby said shoe support will move outward of said cover when said shoe rest is received in said aperture, said flexible means resisting said outward movement of said shoe support.

* * * * *